United States Patent [19]

Snyder

[11] Patent Number: 4,966,287

[45] Date of Patent: Oct. 30, 1990

[54] PORTABLE HOLDER AND ORGANIZER FOR JEWELRY AND ACCESSORIES

[76] Inventor: Rory S. Snyder, 2500 N. Tamiami Trail, Suite 107, Naples, Fla. 33940

[21] Appl. No.: 393,886

[22] Filed: Aug. 15, 1989

[51] Int. Cl.[5] ..... A47F 7/00

[52] U.S. Cl. ..... 211/13; 311/113

[58] Field of Search ..... 211/13, 113, 118, 87, 211/88, 60.1; 206/566

[56] References Cited

U.S. PATENT DOCUMENTS

| | | | |
|---|---|---|---|
| D. 175,456 | 8/1955 | Behlefeldt | 211/113 X |
| 3,081,881 | 3/1963 | Seeger | 211/13 |
| 3,138,259 | 6/1964 | Sitt | 211/113 X |
| 3,339,745 | 9/1967 | Sugerman | 211/13 |
| 3,718,260 | 2/1973 | Sharp | 211/13 |
| 3,831,826 | 8/1974 | Thomas | 211/113 X |
| 3,860,154 | 1/1975 | Atkins | 211/113 X |
| 4,775,053 | 10/1988 | Geiger | 211/13 |

*Primary Examiner*—Alvin C. Chin-Shue
*Assistant Examiner*—Sarah A. Lechok
*Attorney, Agent, or Firm*—William F. Hamrock

[57] ABSTRACT

The portable holder-organizer of the invention includes a top section having hook at its top and a triangular display section and a bottom display section attached thereto having horizontal display strips, display rods and circular side catches attached to vertical supports.

10 Claims, 2 Drawing Sheets

PORTABLE HOLDER AND ORGANIZER FOR JEWELRY AND ACCESSORIES

BACKGROUND OF THE INVENTION

1. Field of the Invention

The invention relates to a portable hanger-holder for organizing, displaying and storing jewelry and accessories.

2. Description of the Prior Art

There is a problem in the prior art in obtaining suitable means for organizing, jewelry and accessories.

This problem in particular is associated with organizing, displaying and storing jewelry, such as, rings, earrings, necklaces and bracelets, and accessories including various types of pins, such as, stick pins, hat pins, scarf pins, hair pins, etc., and clothing items, such as belts, scarves, bows, ties, etc.

These jewelry and accessory items are quite often stored in jewelry boxes or other storage containers or drawers. Persons preparing to use these items are required to search through the clutter in order to choose the desired matching combination of earrings, necklace, bracelet or other item to be worn. It frequently results in a time consuming and frustrating experience. In many instances, the person does not have a clear view of all of the items, which makes it difficult in choosing the desired matching combination of jewelry and accessory.

Various devices have been proposed in order to overcome the problems associated with organizing, displaying and storing jewelry and accessories. Such a device in U.S. Pat No. 4,775,053 has a framework of wooden bars containing hooks to hang the jewelry and holes in the bars to fit some of the shafts of pierced earrings but the device has many limitations. It must be attached to a wall and usually be open to view at all times; it cannot hold short-shafted pierced earrings and necklaces are not held securely by the hooks but are subject to falling off upon moving the device. In U.S. Pat. No. 4,420,084 the book-type device is restricted to holding only earrings and usually must be stored in an out-of-the-way area. U.S. Pat. No. 3,718,260 is directed to a complex display device cluttered with various articles of jewelry and clothing.

Thus, a need exists by consumers to a holder for jewelry and accessories which is portable in that it can be easily placed or stored in many locations, which attractively organizes the jewelry items so that all items can be clearly viewed, which is easy to use in selecting and matching the proper combination of earrings, and bracelet and accessories which securely holds the items in place without falling off the holder.

SUMMARY OF THE INVENTION

According to the present invention, a portable display holder for jewelry and accessories is provided which solves many of the problems of the prior art. It can be made of durable plastic or other material satisfactory for its use.

The portable holder and organizer of the invention includes a top section having a hanger hook at its top and a triangular display section, and a bottom display frame attached thereto and having horizontal display strips, display rods and circular side catches attached to vertical supports.

In one preferred embodiment, the triangular top section resembles a coat hanger having triangular rod supports, which not only permits the device to be portable but also allows it to be hung or stored in many locations. In another preferred embodiment, the hanging device at the top of the triangular top section comprises two hooks hingedly attached to each other which likewise results in a portable device which can be hung in many areas such as in a closet or in any suitable location. The rectangular display section includes a sheet of plastic or other durable material fitted within the rod supports.

The display frame includes an upper section containing several thin strips of plastic or other durable material attached to the vertical supports. The lower section includes a number of horizontal rods interconnected with the vertical supports. The circular side catches include a number of circular catches attached to the outer vertical supports.

The plastic strips are for displaying earrings. The through the strip. In one embodiment, only miniature holes are required which are sufficient to hold pierced earrings in place. This step is accomplished by removing the clip from the earring shaft through a hole in the strip, then fitting the clip onto the shaft and tightening it in place on the strip.

In an embodiment for holding clip earrings, larger holes or slots are provided on the strip to hold clip earrings in place. In this embodiment, the clip earring is positioned in the hole or slot and fixed in place.

In a further embodiment, the display frame may contain plastic strips for holding pierced earrings as well as plastic strips for holding clip earrings. This allows for a display frame for displaying both pierced earrings and clip earrings on the same unit.

Below the strips for the earrings are horizontal rods for displaying necklaces. The necklaces are secured in place on the rod by simply unhooking the clasp, fitting the hooked necklace around the rod and refastening the clasp. The necklace is then securely attached to the bar. In another embodiment, the bars may be sectionalized such as with brackets or other means to prevent the necklaces from sliding about. In this case, the necklace is simply fitted within the space between the brackets.

The triangular display section resembles a peg board and has a multitude of pin holes so that different types of pin items and other accessories can be fitted thereto. Included in these items are the many hair pin items, hat and scarf pins, and broaches. Depending upon the length of the pin, the pins can be slipped through the holes broadside until firmly held in place.

The side snap rings include a circular durable plastic rod having a frictional locking device or other locking device or other locking means permitting appropriate opening and closing of the catch. The individual snap rings can be made to hold many types of jewelry or accessory items, wedding rings, for example, and other rings. Clothing items such as scarves, belts, ties, etc. also can be easily secured thereto. Any accessory that can be slipped-on or hooked-on-or-around the circular bar can be held by the side catches.

There are numerous advantages to the present jewelry and accessory holder and organizer over the prior art.

1. It is an attractive, durable, portable jewelry and accessory display device which can be hung either in open view or stored out of sight in a closet or other secluded area.
2. The jewelry and accessories are firmly secured to the device and not subject to falling off.

3. The jewelry and accessories are organized in an orderly fashion so that choosing of the proper combination is made easy.

These and other objects of the invention are met by a

BRIEF DESCRIPTION OF THE INVENTION

DETAILED DESCRIPTION OF THE INVENTION

Figure 1:
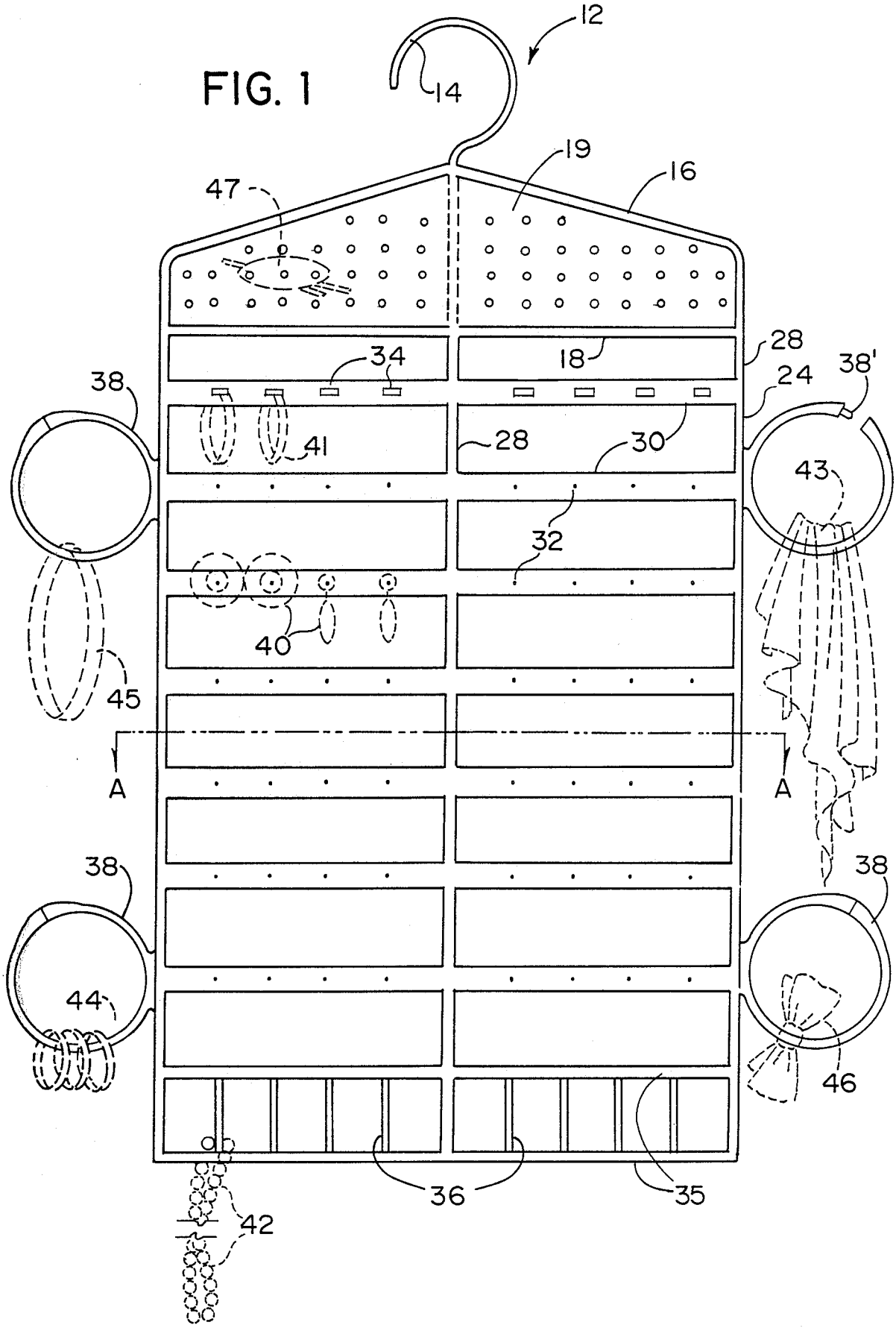
FIG. 1 is elevation view of a jewelry and accessory holder and organizer of the present invention.

FIG. 1 illustrates a preferred embodiment of the invention showing a jewelry and accessory holder and organizer 10 having pierced earrings 40, necklace 42, hat pin 47 and bow 46 attached thereto. The holder and organizer 10 includes a hanger 12, triangular display section 19 and a display section 24. The hanger 12 has a hanger hook 14 at its top connected to side bars 16 connected to bottom bar 18 enclosing triangular display section 19. The hanger 12 and bars 16 and 18 resemble a coat hanger and make the entire unit not only portable but also extremely versatile in that it can be hung in practically any desired location. Side bars 16 and bottom bar 18 enclose and support triangular display section 19. Display 19 is made from a durable plastic sheet or other durable sheet material containing numerous miniature holes for holding hat pins, stick pins, scarf pins, etc. The hat pin, and other pins or other items can be slipped through holes broadside and firmly held in place.

The display frame 24 is attached to hanger 12 and includes three vertical supports 28 having display limbs 30 attached thereto. The display limbs 30 are made from durable plastic strip or similar material. The lower area of the display frame 24 includes two parallel horizontal bars 35 interconnected with the vertical supports 28. Several vertical brackets 36 connect the parallel bars and form a number of sections therebetween.

Each display limb 30, as shown, contains four pairs of miniature holes 32 to accommodate four pairs of pierced earrings. An earring is attached to the display by inserting the needle shaft of the earring through a hole in display limb 30 and is attached thereto by locking on the back of the earring to the shaft. Accordingly, the display frame 24, as depicted in FIG. 1 showing seven display limbs, will accommodate a total of 28 pairs of pierced and clip-on earrings. However, the device is not to be restricted to a specific size or number of items to be displayed. The entire unit can be made of any size suitable for the purpose.

The top display limb 30, as shown, is designed for holding clip-on earrings while the six bottom limbs 30 are designed for holding pierced earrings. It is the same limb structure in each case except that the top limb clip-on earring strip contains miniature slots 34 for holding clip-on earrings and the six pierced earrings display limbs contain miniature holes 32 for holding the pierced earrings. It is emphasized that the jewelry accessory holder-organizer of this invention can contain horizontal limbs 30 for just pierced earrings or for just clip-on earrings or for any combination of limbs therefor.

The parallel horizontal bars 35 sectionalized by the vertical brackets 36 are for displaying necklaces. This step is accomplished by draping an open necklace around the horizontal bar and locking the necklace at its clasp. The necklace is prevented from moving sideways by the brackets. The bars and brackets can be of the same material as that of vertical supports 28.

Side snap rings 38 comprise a durable circular plastic rod having a frictional locking device 38 or other locking means. There are four snap rings shown in FIG. 1 attached to the exterior vertical bars 28. However, any number of snap rings can be attached as required.

The snap rings 38 can be made to hold many types of jewelry and accessory items. Shown in FIG. 1 are rings 44, bracelets 45, and clothing items 43 and 46 secured in place.

The jewelry and accessory holder-organizer can be stored, for example, in a closet which will keep it out of sight but be available for immediate use. In choosing the proper combination, the device can be placed on a flat surface or hung up for viewing. A necklace can then be matched with the proper pair of earrings and other jewelry or accessory item by holding up the necklace close to the earrings and items and matching the combination.

Figure 2:
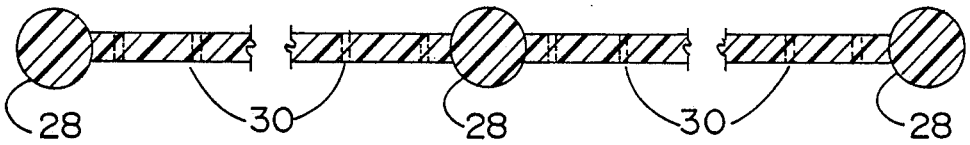
FIG. 2 is a view of through section A-A.

FIG. 2 shows a section of the hanger-holder along A-A.

Figure 3:
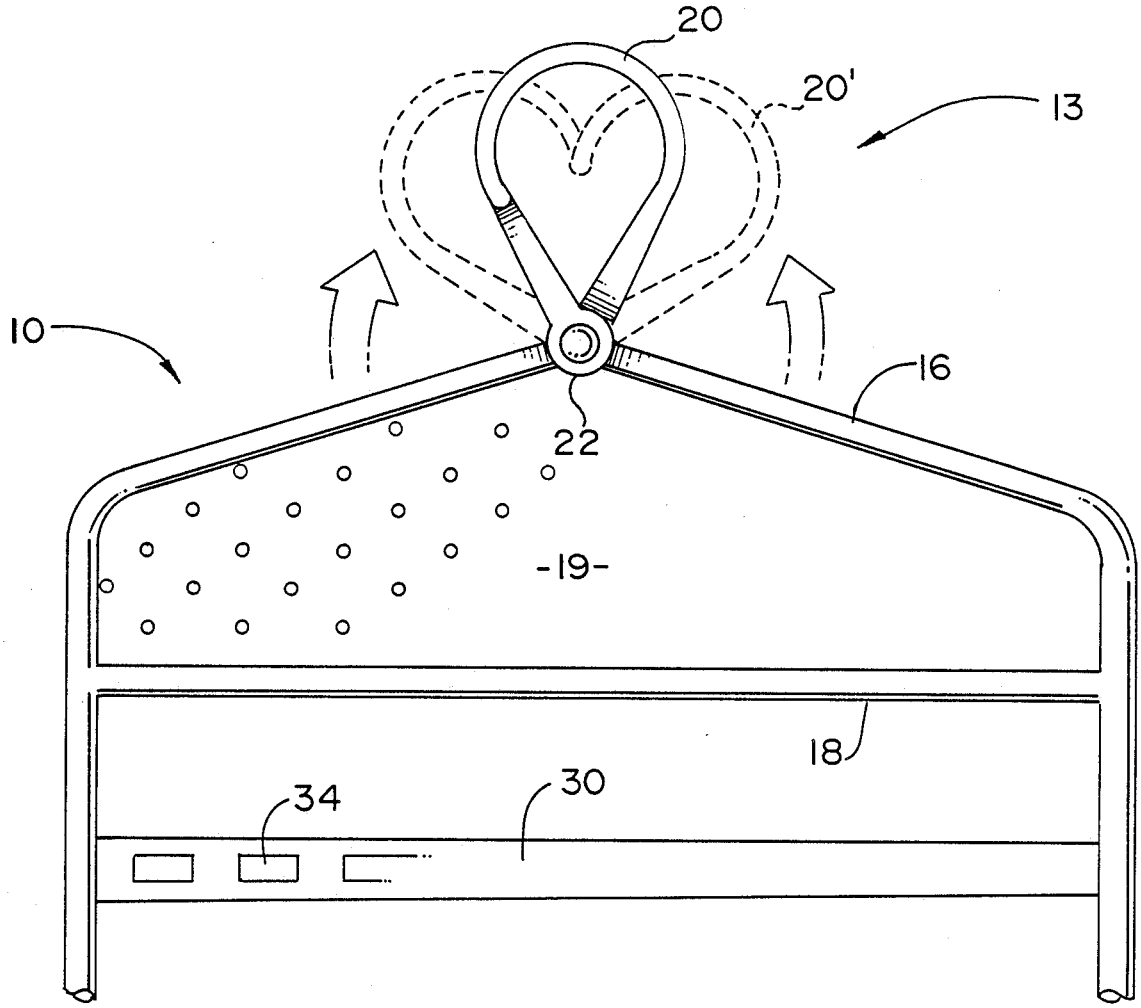
FIG. 3 is a front view of an alternative hinged hooks hanger.

FIG. 3 shows a further embodiment of a hanger-holder wherein a hanger containing two hooks 20 attached to each other by means of hinge 22 is depicted. This hanger-hook 13 will operate similarly to hanger-hook 12 as described above.

Further, it will be apparent to those skilled in the art from the foregoing description and accompanying drawings that additional modification and/or changes of the disclosed embodiments may be made without departure from the invention. Accordingly, it is expressly intended that the foregoing description and accompanying drawings are illustrative of preferred embodiments only, not limiting, and that the true spirit and scope of the present invention be determined by the reference to the appended claim.

What is claimed is:

1. A portable holder-organizer for displaying jewelry and accessories comprising an upper section having a hanger hook means extending from a top peak, and a triangular sheet display section, a lower display frame attached to the upper section comprising at least two vertically spaced supporting means having a plurality of equally spaced horizontal display strips and at least two horizontal display rods secured thereto, a plurality of snap rings attached to said vertically spaced supporting means, whereby said triangular section has miniature openings therein for holding pin items, said display strips having a plurality of miniature openings therein for holding earrings, said display rods capable of holding necklaces and said snap rings capable of holding jewelry and accessories.

2. A portable holder-organizer according to claim 1 whereby said display rods are secured to said supporting means below said strips.

3. A portable holder-organizer according to claim 2 whereby said miniature openings in said display strips include miniature holes for securely holding pierced earrings.

4. A portable holder-organizer according to claim 2 whereby said miniature openings in said display strips include miniature slots for securely holding clip earrings.

5. A portable holder-organizer according to claim 3 whereby said hanger hook means is a single hook.

6. A portable holder-organizer according to claim 3 whereby said hanger hook means comprises two hingedly joined hooks forming a heart-shaped structure.

7. A portable holder-organizer according to claim 5 whereby said display frame comprises three vertical supporting rods, seven horizontal strips, each of said strips containing eight equally spaced miniature holes, and two parallel horizontal display rods bracketed into sections and four snap rings.

8. A portable holder-organizer according to claim 5 whereby said horizontal display rods include a plurality of vertical brackets forming sections for holding individual necklaces.

9. A portable holder-organizer according to claim 5 prepared from durable plastic.

10. A portable holder-organizer according to claim 9 prepared by injecting molding.

* * * * *